US009689167B2

(12) United States Patent
Teng

(10) Patent No.: US 9,689,167 B2
(45) Date of Patent: Jun. 27, 2017

(54) TILE LEVELER

(71) Applicant: Ching-Tien Teng, Taichung (TW)

(72) Inventor: Ching-Tien Teng, Taichung (TW)

( * ) Notice: Subject to any disclaimer, the term of this patent is extended or adjusted under 35 U.S.C. 154(b) by 152 days.

(21) Appl. No.: 14/825,223

(22) Filed: Aug. 13, 2015

(65) Prior Publication Data

US 2017/0044779 A1 Feb. 16, 2017

(51) Int. Cl.

| | |
|---|---|
| ***G01B 5/25*** | (2006.01) |
| ***E04F 21/18*** | (2006.01) |
| ***E04F 21/20*** | (2006.01) |

(52) U.S. Cl.

CPC ..... *E04F 21/1877* (2013.01); *E04F 21/20* (2013.01)

(58) Field of Classification Search

CPC .. E04F 21/092; E04F 21/1838; E04F 21/1877
USPC ..... 33/526, 527, 613, 645
See application file for complete search history.

(56) References Cited

U.S. PATENT DOCUMENTS 2,930,135 A * 3/1960 Rodtz, Sr. ..... E04F 21/0092 33/195
7,946,093 B1 * 5/2011 Sturino ..... E04F 21/0092 33/527
2002/0121027 A1 * 9/2002 Kruskamp ..... E04F 21/0092 33/526
2009/0126213 A1 * 5/2009 Tavy ..... E04F 21/0092 33/527
2014/0283401 A1 * 9/2014 Kufner ..... E04F 21/0092 33/527
2014/0325935 A1 * 11/2014 Hoffman ..... E04F 21/22 52/747.11
2015/0211243 A1 * 7/2015 Irvine ..... E04F 21/0092 52/126.1
2015/0354231 A1 * 12/2015 Bordin ..... E04F 21/20 52/126.6

* cited by examiner

*Primary Examiner* — G. Bradley Bennett
(74) *Attorney, Agent, or Firm* — Alan D. Kamrath; Kamrath IP Lawfirm, P.A.

(57) ABSTRACT

A tile leveler contains a pressing seat, a retainer, and a direction changing unit. The pressing seat includes a protruded post extending upwardly from a top thereof, a threaded orifice defined in the protruded post, and a rotary extension extending outwardly from the protruded post. The retainer includes a connecting column formed on a top thereof, a connection rod defined on a middle section thereof, an inserting plate arranged on a bottom thereof, and two retaining portions, wherein each retaining portion is formed on each of two sides of a top of the inserting plate. The direction changing unit includes a first direction changer and a second direction changer which contact with each other. The first direction changer has a first recess, a first slot, and first outer threads. The second direction changer has a second recess, a second slot, and second outer threads.

6 Claims, 7 Drawing Sheets

TILE LEVELER

FIELD OF THE INVENTION

The present invention relates to a tile leveler which aligns and affixes tiles flatly.

BACKGROUND OF THE INVENTION

Tiles are manually aligned and affixed on a ground or on a wall by using a hand tool. However, such a manual affixing manner is time-consuming and the tiles cannot be aligned precisely.

The present invention has arisen to mitigate and/or obviate the afore-described disadvantages.

SUMMARY OF THE INVENTION

The primary objective of the present invention is to provide a tile leveler in which a direction changing unit is rotated so that an inserting plate is parallel to a gap between two adjacent tiles, and the inserting plate removes from the gap by pulling the direction changing unit upwardly, hence when the inserting plate is broken during removing the tile leveler, the direction changing unit is removed from a pressing seat, and a retainer is disengaged from a first slot and a second slot for replacement, thus reducing material consumption cost.

DETAILED DESCRIPTION OF THE PREFERRED EMBODIMENTS

Figure 1:
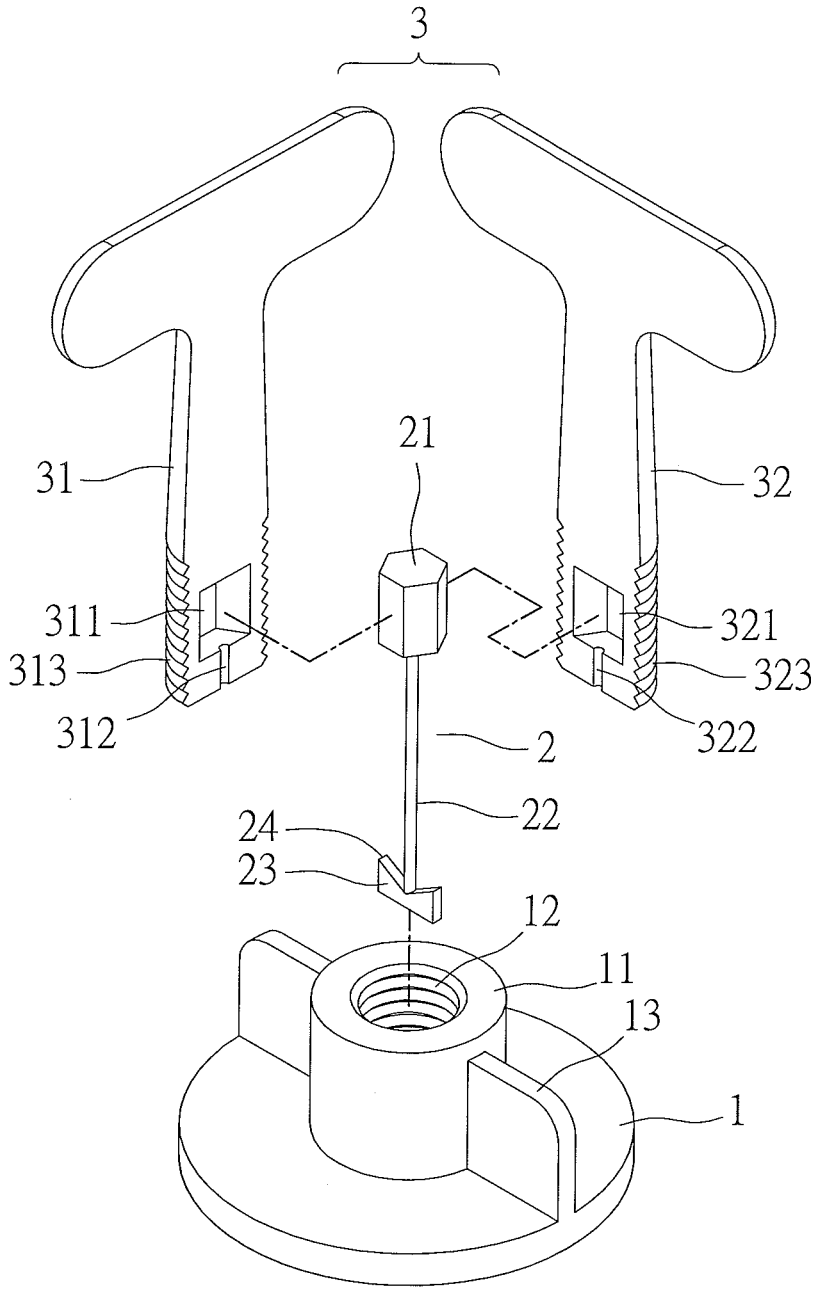
FIG. 1 is a perspective view showing the exploded components of a tile leveler according to a preferred embodiment of the present invention.
Figure 2:
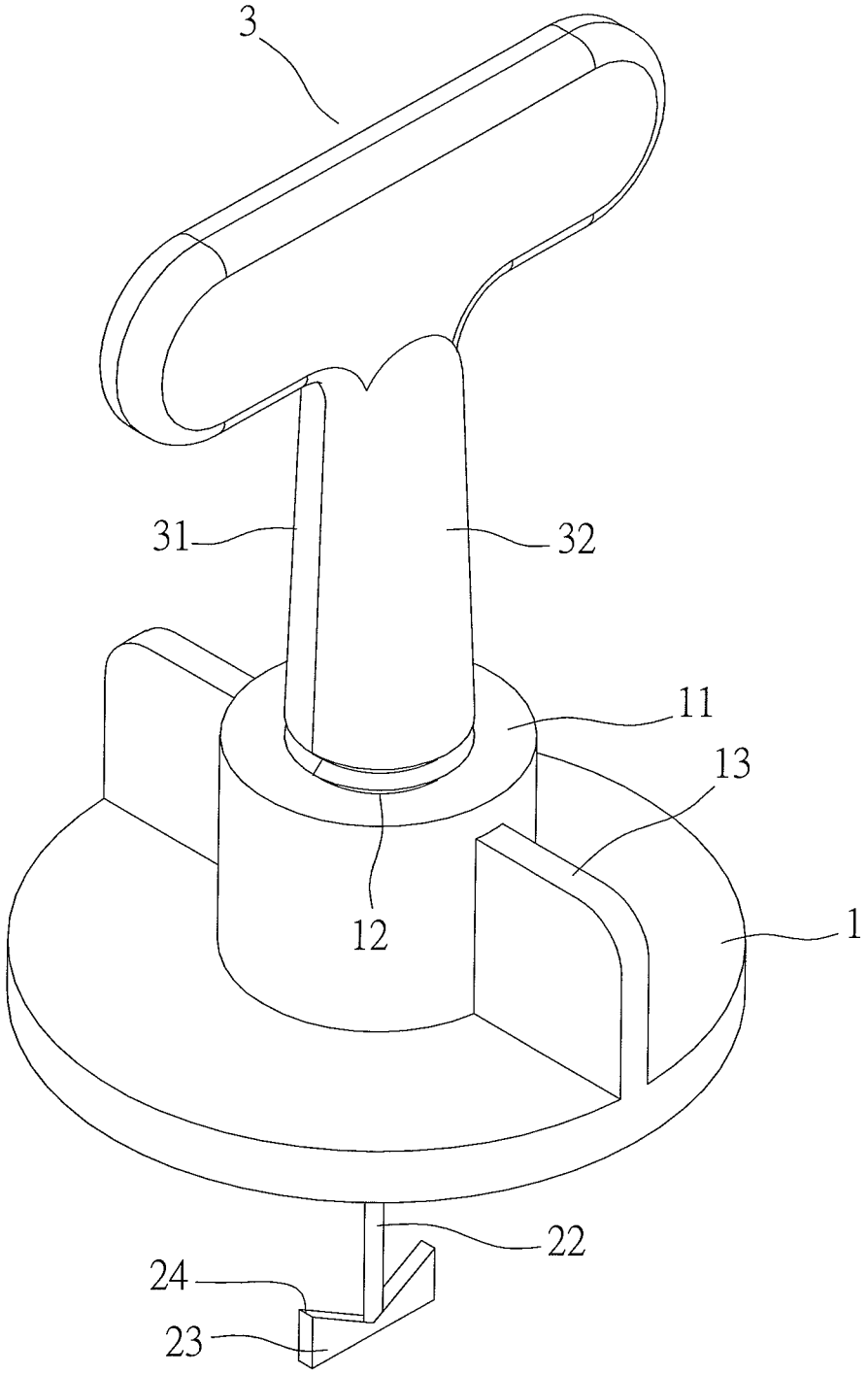
FIG. 2 is a perspective view showing the assembly of the tile leveler according to the preferred embodiment of the present invention.
Figure 3:
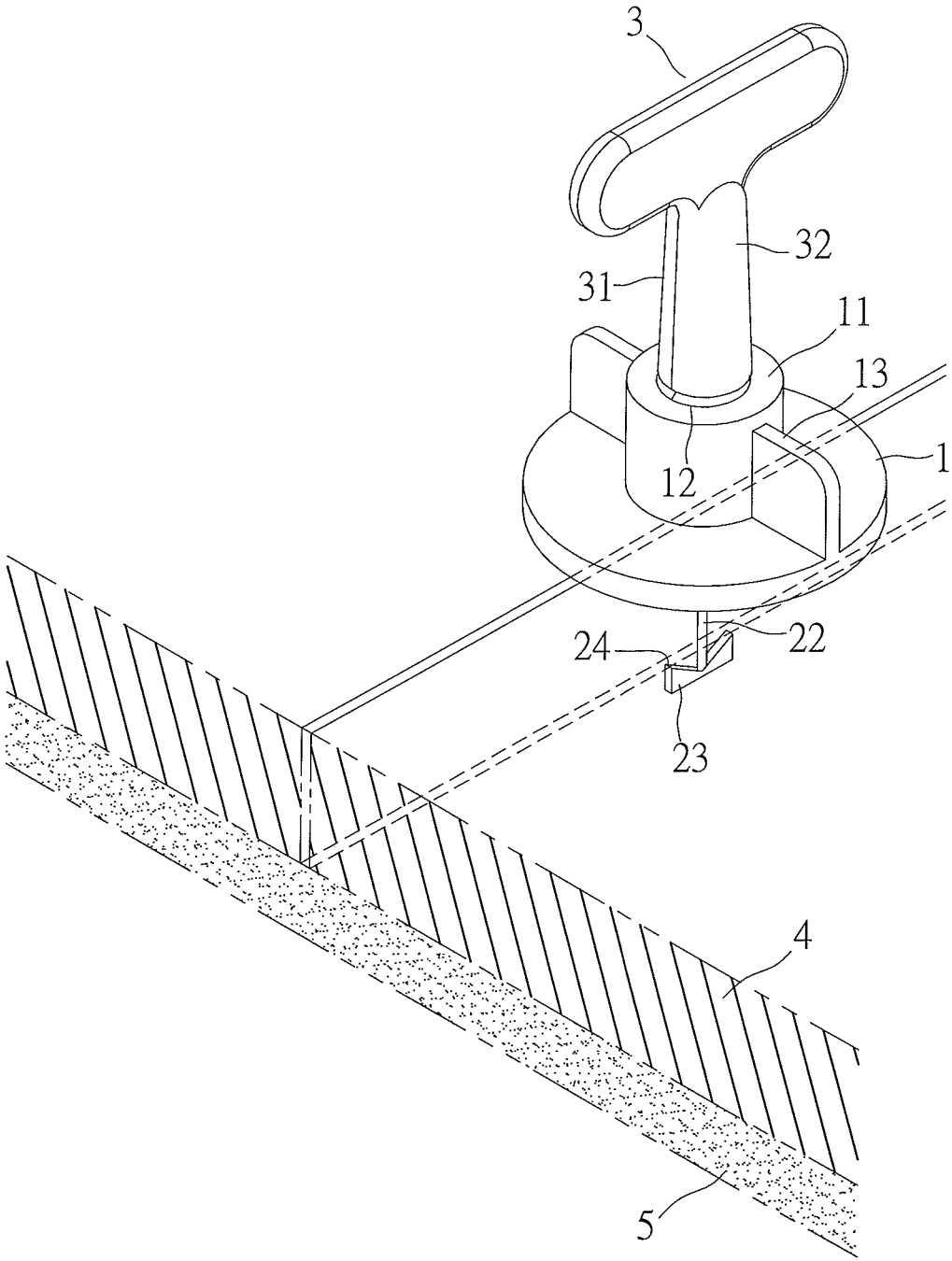
FIG. 3 is a perspective view showing the operation of the tile leveler according to the preferred embodiment of the present invention.
Figure 4:
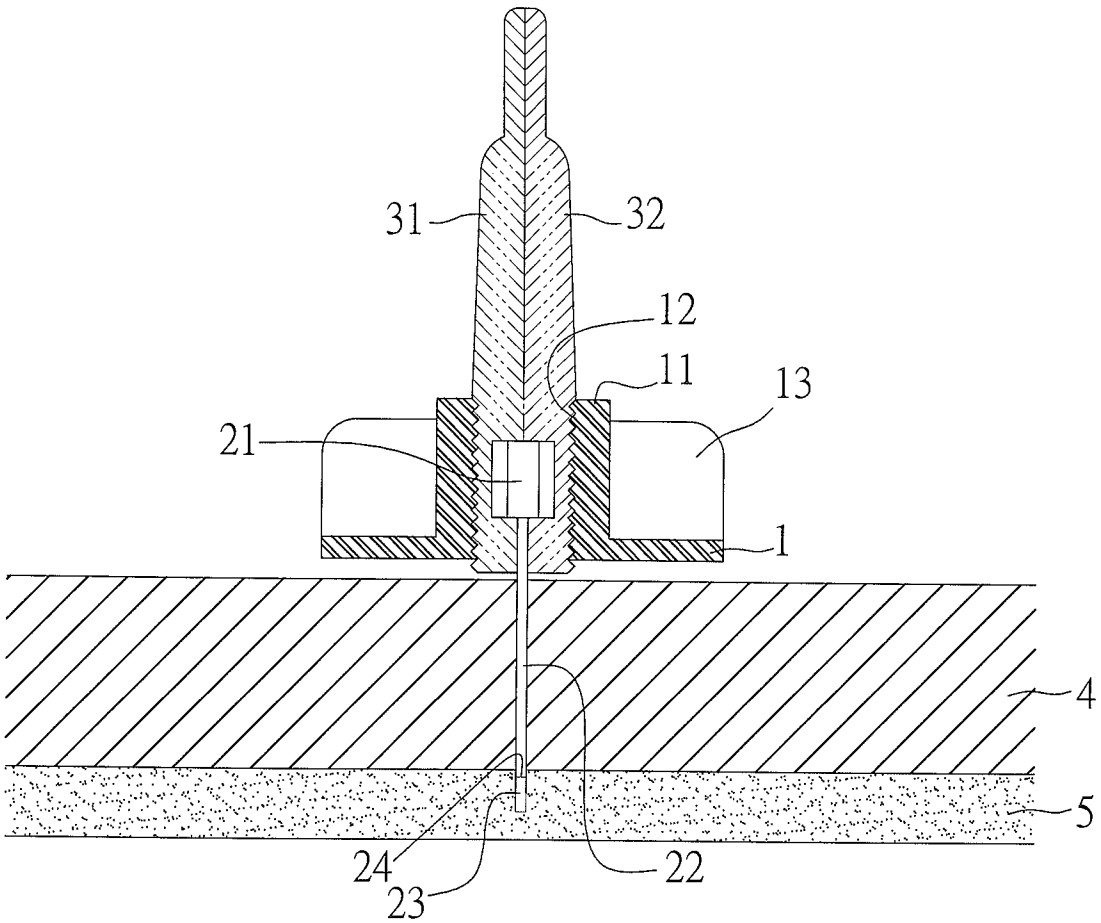
FIG. 4 is a cross sectional view showing the operation of the tile leveler according to the preferred embodiment of the present invention.
Figure 5:
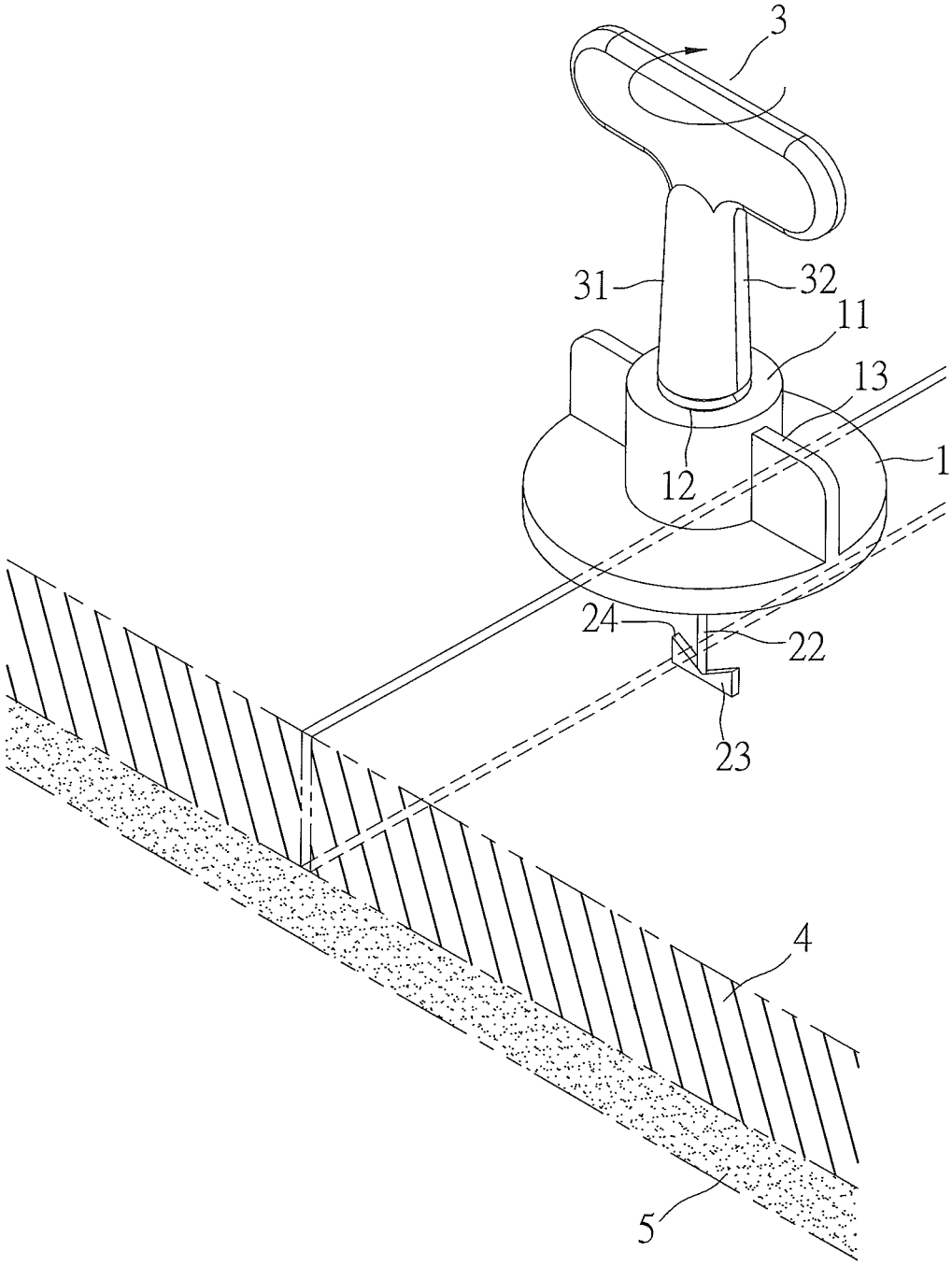
FIG. 5 is another perspective view showing the operation of the tile leveler according to the preferred embodiment of the present invention.
Figure 6:
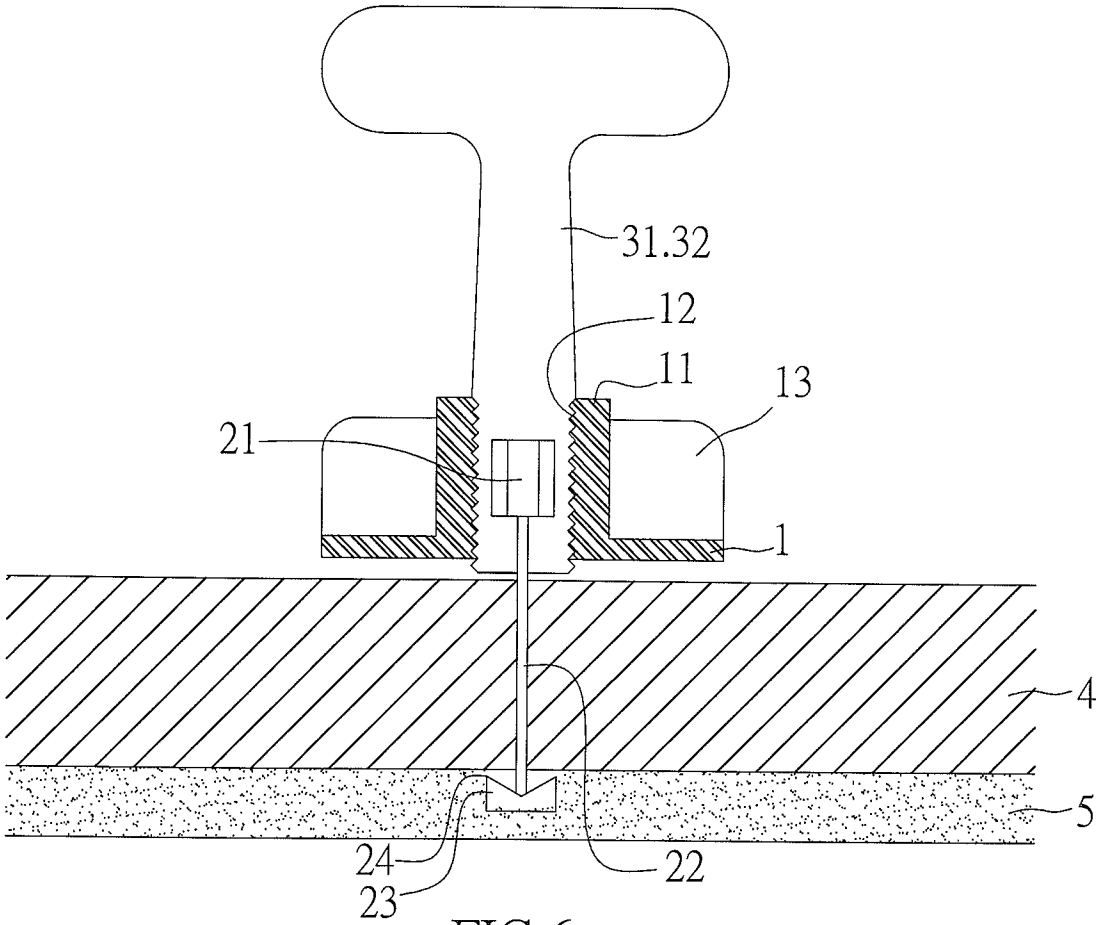
FIG. 6 is another cross sectional view showing the operation of the tile leveler according to the preferred embodiment of the present invention.
Figure 7:
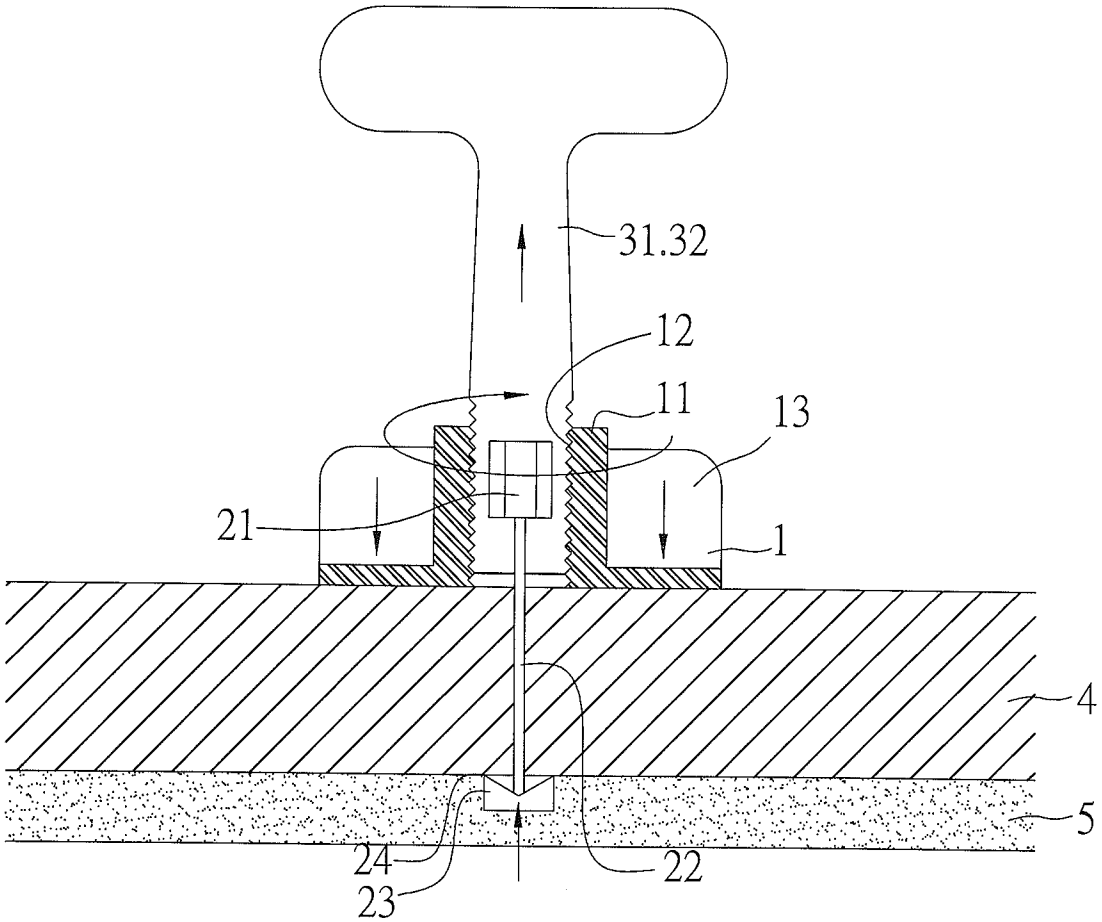
FIG. 7 is also another cross sectional view showing the operation of the tile leveler according to the preferred embodiment of the present invention.

Referring to FIGS. 1 and 2, a tile leveler according to a preferred embodiment of the present invention comprises: a pressing seat 1, a retainer 2, and a direction changing unit 3.

The pressing seat 1 includes a protruded post 11 extending upwardly from a top thereof, a threaded orifice 12 defined in the protruded post 11, and a rotary extension 13 extending outwardly from two sides of an outer wall of the protruded post 11, wherein a bottom of the pressing seat 1 is level.

The retainer 2 includes a connecting column 21 formed on a top thereof, a connection rod 22 defined on a middle section thereof, an inserting plate 23 arranged on a bottom thereof, and two retaining portions 24, wherein each retaining portion 24 is formed on each of two sides of a top of the inserting plate 23, wherein the connecting column 21 is noncircular or polygonal, and each of the two retaining portions 24 has a sharp tip arranged on a tip top thereof.

The direction changing unit 3 includes a first direction changer 31 and a second direction changer 32 which contact with each other, wherein the first direction changer 31 has a first recess 311 defined in a lower end thereof to retain with the connecting column 21 and has a first slot 312 defined in the lower end thereof below the first recess 311 to retain with an upper end of the connection rod 22, the first direction changer 31 further has first outer threads 313 formed on an outer side of the lower end thereof to screw with the threaded orifice 12 of the pressing seat 1. The second direction changer 32 has a second recess 321 defined in a lower end thereof to retain with the connecting column 21 and has a second slot 322 defined in the lower end thereof below the second recess 321 to retain with the upper end of the connection rod 22, the second direction changer 32 further has second outer threads 323 formed on an outer side of the lower end thereof to screw with the threaded orifice 12 of the pressing seat 1. The first recess 311 and the second recess 321 correspond to the connecting column 21. Preferably, an inner surface of each of the first direction changer 31 and the second direction changer 32 is level.

With reference to FIGS. 3 to 7, in operation, the inserting plate 23 of the retainer 2 is inserted into a gap between two adjacent tiles 4 and a cement surface below the two adjacent tiles 4, and the direction changing unit 3 is rotated to drive the connecting column 21 to revolve so that the inserting plate 23 is perpendicular to the gap between the two adjacent tiles 4. Thereafter, the pressing seat 1 is fitted on the retainer 2, and the inner surface of the first direction changer 31 contacts with the inner surface of the second direction changer 32, such that the connecting column 21 retains in the first recess 311 and the second recess 321, and the first outer threads 313 of the first direction changer 31 and the second outer threads 323 of the second direction changer 32 screw with the threaded orifice 12 of the pressing seat 1. The pressing seat 1 is rotated to contact with the two adjacent tiles 4, and the direction changing unit 3 is rotated so that the two retaining portions 24 abut against the two adjacent tiles 4, thus aligning and affixing the two adjacent tiles 4.

As desiring to remove the tile leveler, the direction changing unit 3 is rotated so that the inserting plate 23 is parallel to the gap between the two adjacent tiles 4, and the inserting plate 23 removes from the gap by pulling the direction changing unit 3 upwardly. Preferably, when the inserting plate 23 is broken during removing the tile leveler, the direction changing unit 3 is removed from the pressing seat 1, and the retainer 2 is disengaged from the first slot 312 and the second slot 322 for replacement, thus reducing material consumption cost.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A tile leveler comprising:

a pressing seat including a protruded post extending upwardly from a top thereof, a threaded orifice defined in the protruded post, and a rotary extension extending outwardly from two sides of an outer wall of the protruded post;

a retainer including a connecting column formed on a top thereof, a connection rod defined on a middle section thereof, an inserting plate arranged on a bottom thereof, and two retaining portions, each retaining portion being formed on each of two sides of a top of the inserting plate;

a direction changing unit including a first direction changer and a second direction changer which contact with each other, wherein the first direction changer has a first recess defined in a lower end thereof to retain with the connecting column and has a first slot defined in the lower end thereof below the first recess to retain with an upper end of the connection rod, the first direction changer further has first outer threads formed on an outer side of the lower end thereof to screw with the threaded orifice of the pressing seat, and the second direction changer has a second recess defined in a lower end thereof to retain with the connecting column and has a second slot defined in the lower end thereof below the second recess to retain with the upper end of the connection rod, the second direction changer further has second outer threads formed on an outer side of the lower end thereof to screw with the threaded orifice of the pressing seat.

2. The tile leveler of claim 1, wherein the connecting column is noncircular or polygonal.

3. The tile leveler of claim 2, wherein the first recess and the second recess correspond to the connecting column.

4. The tile leveler of claim 1, wherein a bottom of the pressing seat is level.

5. The tile leveler of claim 1, wherein an inner surface of each of the first direction changer and the second direction changer is level.

6. The tile leveler of claim 1, wherein each of the two retaining portions has a sharp tip arranged on a tip top thereof.

* * * * *